US005455756A

United States Patent [19]

Sumer et al.

[11] Patent Number: 5,455,756

[45] Date of Patent: Oct. 3, 1995

[54] PORTABLE LIGHTING FIXTURE

[75] Inventors: Suleyman O. Sumer, Chapel Hill; Brian L. Spitler, Elon College, both of N.C.

[73] Assignee: Regent Lighting Corporation, Burlington, N.C.

[21] Appl. No.: 376,021

[22] Filed: Jan. 20, 1995

[51] Int. Cl.[6] ..... F21L 3/00

[52] U.S. Cl. ..... 362/376; 362/310; 362/375; 362/400

[58] Field of Search ..... 362/376, 310, 362/311, 374, 375, 400, 455, 399

[56] References Cited

U.S. PATENT DOCUMENTS

| | | | |
|---|---|---|---|
| 5,195,823 | 3/1993 | Sidabras | 362/376 X |
| 5,243,507 | 9/1993 | Atkins et al. | 362/376 |
| 5,392,201 | 2/1995 | Morley et al. | 362/376 X |

*Primary Examiner*—Ira S. Lazarus

*Assistant Examiner*—Thomas M. Sember

[57] ABSTRACT

This portable lighting fixture comprises a lamp housing containing a lamp and a reflector that projects light from the lamp through an opening in the front face of the housing. A protective grill on the housing registers with the front-face opening in a location spaced from the opening. Normally located beneath the housing is a base that normally supports the housing. The grill has an outer periphery that appears rounded when viewed from a horizontal reference plane located above the housing when the housing is in its normal location atop the base. Tip-over of the fixture onto a horizontal surface that causes the central peripheral portion of the grill to fall against the horizontal surface results in the fixture rolling over in a lateral direction on the rounded grill following initial contact between the central peripheral portion of the grill and the horizontal surface. This roll-over action causes heat that is emitted through the front-face opening of the fixture to be directed via a path that is oriented to produce reduced heating of the support surface under these conditions.

13 Claims, 3 Drawing Sheets

PORTABLE LIGHTING FIXTURE

FIELD OF THE INVENTION

This invention relates to a portable lighting fixture comprising a lamp housing having a front face and an opening in the front face through which a hot beam of light is emitted and, more particularly, relates to a lighting fixture of this type that includes means for protecting against heat and/or fire damage should the fixture be accidentally tipped over in the direction of said front face.

BACKGROUND

To protect against damage by the heat emitted through the front-face opening of the lamp housing in a portable lighting fixture, it is customary to provide the lamp housing with a wire grill that registers with the front face. The grill serves to keep heat-vulnerable objects away from the lamp and other hot parts within the lamp housing, and this serves to reduce the chances that such objects will be ignited or damaged by the heat issuing from the housing through its front-face opening. The grill also allows for the flow of air through the region bounded by the grill in front of the front face, thus cooling the light beam emerging through the front-face opening.

A type of situation that presents a severe test for the ability of the grill to prevent fire and/or heat damage is one in which the portable lighting fixture is accidentally tipped over in the direction of its front face onto a horizontal supporting surface and allowed to remain in its tipped-over position for many hours. Prior lighting-fixture grills have kept the front face of the lamp housing spaced from the horizontal supporting surface following such tip-over; but, typically, the lamp housing has been allowed to remain in its initial tipped-over position so that the hot beam emerging from the housing has been aimed directly at the supporting surface, thus subjecting this surface to a significant risk of heat and/or fire damage. This risk can be reduced by increasing the size of the grill, but this makes the fixture bulkier and more costly.

It would be highly desirable if tip-over of the fixture in the direction of its front face onto a horizontal surface could result in reduced heating of the surface as compared to that occurring with a lighting fixture having a conventional grill. It would be especially desirable if such a reduction in heating could be effected without substantially increasing the size of the grill as compared to that of conventional grills used for fixtures of corresponding wattage.

SUMMARY

In carrying out our invention in one form, we provide a portable lighting fixture comprising a housing in which a high wattage lamp is adapted to be mounted. The housing has two sidewalls, a front face, and an opening in the front face through which light from the lamp is emitted. A protective grill on the housing registers with the front-face opening in a location spaced from and in front of the opening. The fixture further comprises a base normally supporting the housing and atop which the housing is normally located. The grill has an outer periphery that appears rounded when viewed from a horizontal reference plane located above the housing when the housing is in its normal location atop the base. The grill also contains a central peripheral portion when so viewed. Tip-over of the fixture onto a horizontal surface that causes the central peripheral portion of the grill to fall against the horizontal surface results in the fixture rolling over in a lateral direction on the rounded grill following initial contact between said central peripheral portion of the grill and the horizontal surface.

The fixture is unstable in resisting roll-over from its position of initial contact between the central peripheral portion of the grill and said horizontal surface following said tip-over of the fixture, thereby promoting roll-over from this position on the rounded outer periphery of the grill following tip-over. In addition, the base is configured so as to avoid obstructing roll-over of the fixture from said position of initial contact in the event of tip-over of said fixture into said position.

In one embodiment of the invention, the grill, in its normal position, comprises vertically-spaced members that extend generally horizontally and reinforcing members that extend transversely of said horizontally extending members. The reinforcing members are located on the inner surfaces of the horizontally-extending members so that the reinforcing members do not obstruct the above-referred to roll-over of the fixture.

BRIEF DESCRIPTION OF FIGURES

For a better understanding of the invention, reference may be had to the following detailed description taken in connection with the accompanying drawings, wherein.

DETAILED DESCRIPTION OF EMBODIMENTS

Figure 1:
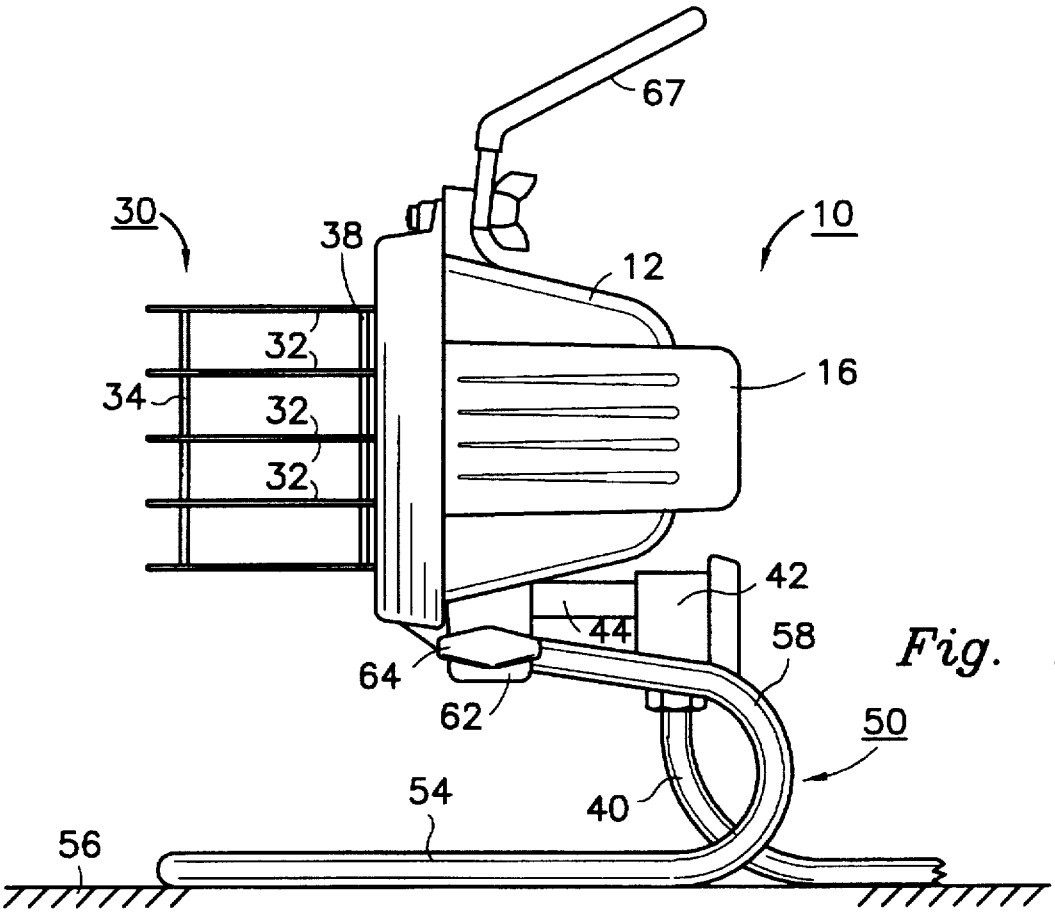
FIG. 1 is a side elevational view of a portable lighting fixture embodying one form of the invention.

Referring now to FIGS. 1–4, the illustrated portable lighting fixture 10 comprises a metal housing 12 in which is located a high wattage lamp 14, typically of the quartz halogen type shown. The housing 12 comprises two spaced-apart sidewalls 16 and a front face 18 extending between the sidewalls. The front face contains an opening 20 in which a transparent lens 22 (FIG. 3) is mounted. Also located within the housing 12 is a trough-shaped reflector 24 (FIGS. 2 and 3) which acts to reflect light from the lamp 14 through the opening 20 in the front face.

Figure 4:
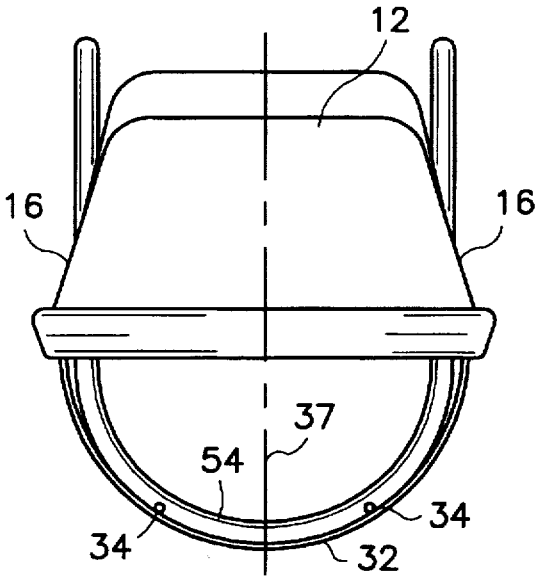
FIG. 4 is a top plan view of the fixture of FIGS. 1 and 2.

Registering with the opening 20 in the front face is a protective grill 30 that comprises a plurality of vertically-spaced wires 32. As illustrated in FIG. 4, each of the wires 32 is bent into a rounded, approximately semi-circular, form, as viewed from a horizontal reference plane above the housing 12. When the housing 12 is in its normal position of FIGS. 1 and 2, the wires 32 extend horizontally. Interconnecting the horizontally-extending wires 32 are two horizontally-spaced, vertically-extending reinforcing wires 34 that are welded to the wires 32 at the locations where wires 32 and 34 intersect. The vertically-extending wires 34 are located on the inside surfaces of the horizontally-extending wires 32 and serve to maintain the horizontally-extending wires properly spaced and to impart rigidity to the grill. Preferably, the vertically-extending wires 34 are located on opposite sides of the central vertical plane 37 of the housing 12 in spaced relationship to such plane.

Near the ends of the horizontally-extending wires 32 there are additional vertically-extending wires 38 that interconnect the wires 32 and reinforce the grill. The ends of the upper and lower horizontally-extending wires 34 extend radially-outward for a short distance and are located within suitable holes in the housing frame, thus rigidly mounting the grill on the housing. It is to be understood that the illustrated means for securing the grill to the housing is only one example of suitable support means for the grill. Other conventional support means for the grill can be utilized.

For supplying power to the lamp 14 within the housing 12, there is provided an insulated cord 40 that enters a terminal box 42 located beneath the housing 12. A conventional on-off switch (not shown) within the box 42 is connected between the conductors of the cord and insulated wires (not shown) that enter the housing 12 through a tubular conduit 44 and are connected to conductive lamp-receiving contacts at opposite ends of the lamp, all in a conventional manner. It is to be understood that the on-off switch is optional. In certain applications, this switch is omitted and the wires of the cord are directly connected to the wires leading to the lamp.

Figure 2:
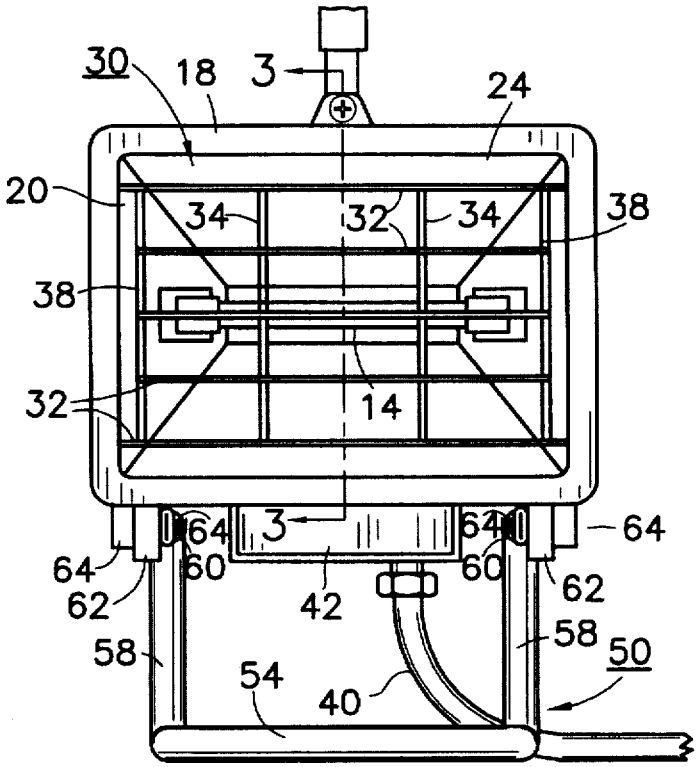
FIG. 2 is a front view of the fixture of FIG. 1.
Figure 3:
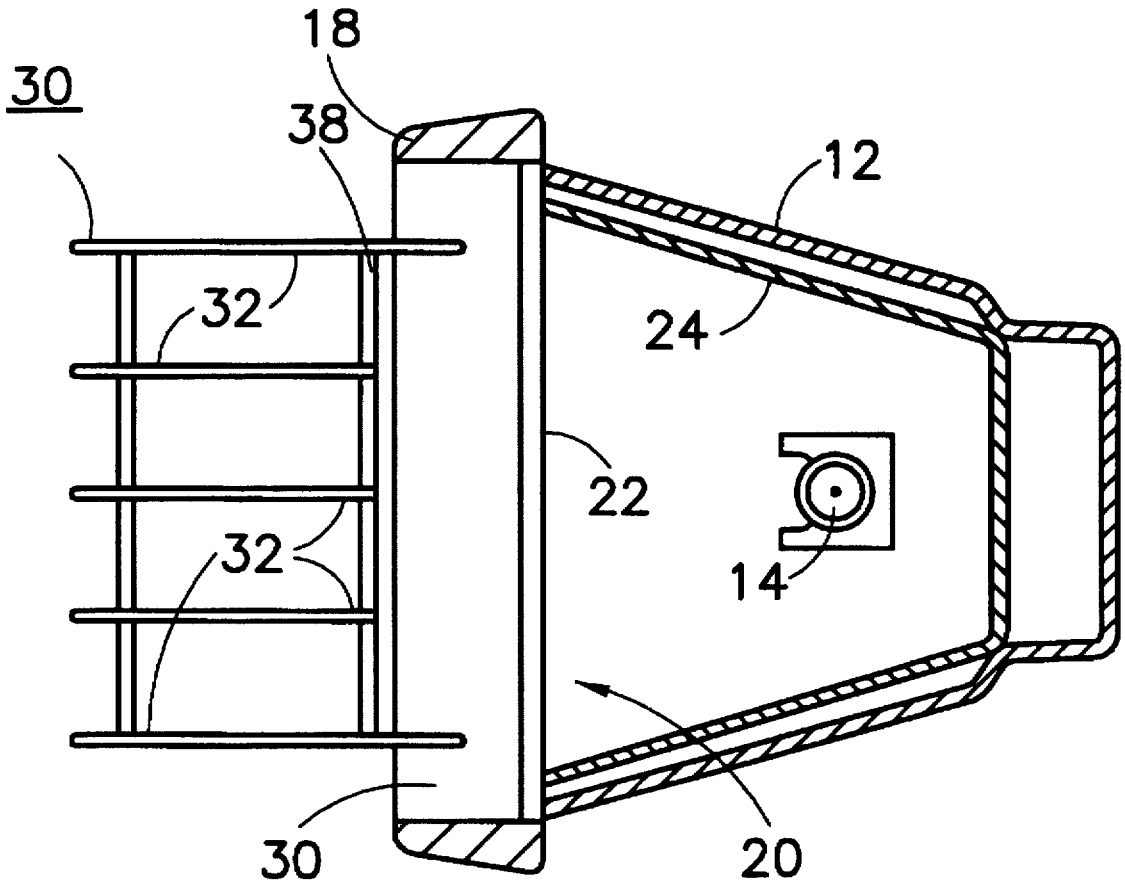
FIG. 3 is a sectional view along the line 3—3 of FIG. 2.

The housing 12 is supported in its position of FIGS. 1 and 2 by a base 50. Base 50 comprises (i) a U-shaped lower portion 54 that is adapted to rest on a horizontal supporting surface 56 and (ii) two spaced-apart upstanding legs 58 that rise from the back of the lower portion 54 to locations beneath the housing 12 near its front face. The legs 58 have flattened portions 60 at their upper ends that are each adjustably connected to downwardly-extending lugs 62 fixed to the bottom of the housing 12.

In the illustrated embodiment, the connection between each set of parts 60 and 62 comprises a headed screw 64 that is threaded into an internally-threaded hole in the flattened portion 60 and extends freely through an aligned hole in lug 62. The holes in the two sets of parts 60 and 62 are aligned so as to locate the screws 64 on a horizontal line that serves as a pivot axis for the housing 12. When the screws 64 are loosened, the housing 12 can be pivoted about this horizontal axis to adjust the light-aiming angle of the fixture. When the housing has been pivoted into a position that provides the desired light-aiming angle, the screws 64 are tightened to clamp the housing in such position. Pivotal adjustments of the housing 12 are effected by applying the necessary force to the housing 12 through a handle 67 fixed to the top of the housing.

As best seen in FIG. 4, the U-shaped lower portion 54 of the base 50 has a rounded configuration when viewed from a horizontal reference plane above the fixture. The significance of this rounded configuration will soon appear more clearly.

When the lighting fixture 10 is turned on, the lamp 14 not only develops light, most of which is reflected by the reflector 24 through the opening 20 in the front face of the fixture, but also develops a large amount of heat which is also reflected by the reflector 24 through the front-face opening 20. The grill 30 serves to reduce the chances that this heat will ignite or otherwise damage adjacent objects by keeping such objects a safe distance from the lamp. One type of situation that must be protected against is that which occurs should the fixture be accidentally tipped over in the direction of its front face onto the horizontal fixture-supporting surface 56.

The protective grills on prior portable lighting fixtures have not been as effective as might be desired in protecting against heat and/or fire damage in the event of such a tip-over. Typically, such prior grills have had flat faces or faces that are curved about a normally horizontal axis. These grill configurations allow the fixture, if tipped over onto a horizontal supporting surface, to remain stationary in a face-down position. As a result, the heat reflected through the front face of the fixture is aimed directly at the horizontal supporting surface. If this surface is flammable and if this condition is allowed to persist for a long period, a risk of fire is present.

Figure 5:
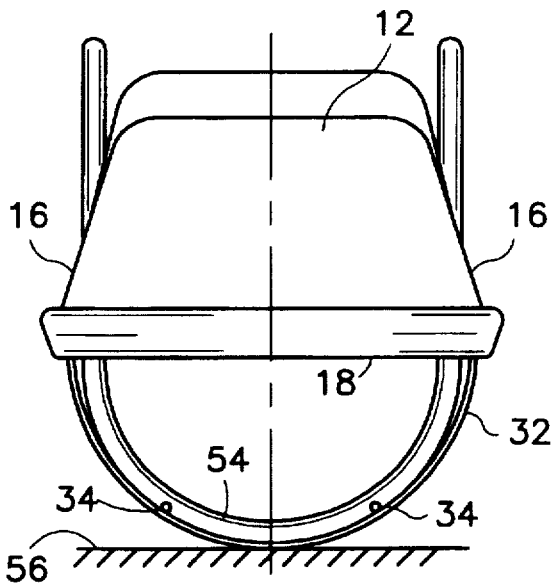
FIG. 5 is a front view of the fixture of FIG. 1 immediately after it has been tipped over onto the grill across its front face.
Figure 6:
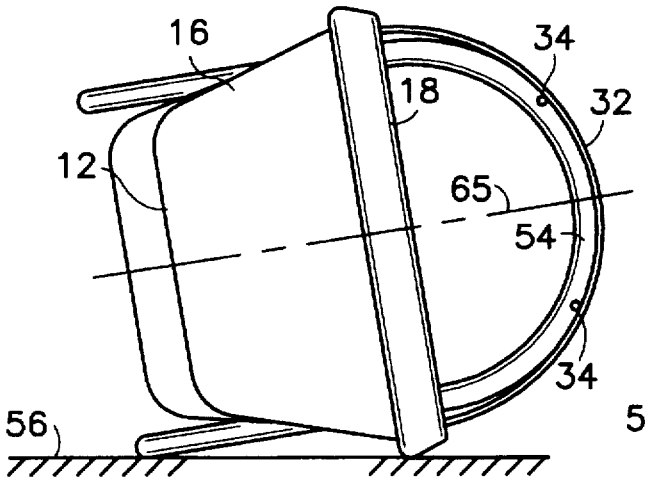
FIG. 6 is a front view of the fixture of FIG. 1 after it has rolled over into a typical resting position following its being tipped-over into the position of FIG. 5.

Our fixture is constructed to significantly reduce this risk of fire. If our fixture should be tipped over into a face-down position such as shown in FIG. 5, it will not remain in this position but will roll over laterally, in some cases into a position such as shown in FIG. 6. In the FIG. 6 position, the heat radiated through the front-face opening of the fixture is not aimed directly at the supporting surface 56 but more into the surrounding air. This will significantly reduce the tendency of the tipped-over fixture to heat the supporting surface, thereby reducing the risk of fire or heat damage from tip-over of the fixture.

There are a number of features which enable our lighting fixture to roll over in a lateral direction from its position of FIG. 5 immediately following a tip-over into this position. One is that the grill 30 has an outer periphery that is rounded when the grill is viewed from a horizontal reference plane above the fixture when the fixture is in its normal position of FIG. 4. Accordingly, when the rounded outer periphery contacts the horizontal surface 56 upon falling into its position of FIG. 5, there is nothing on the grill to impede lateral roll-over, and the grill can therefore act like a round wheel on the horizontal surface. To avoid impeding the desired roll-over of the fixture, the vertical wires 34 of the grill are located on the inside surface of the curved horizontal wires 32, thus presenting a more nearly rounded external grill surface on which the fixture can roll over without impedance. Another feature facilitating roll-over is that the fixture is unstable in resisting lateral roll-over when in its position of FIG. 5. The center of gravity of the tipped-over fixture is far from the supporting surface 56, and the slightest displacement of the center of gravity from the FIG. 5 illustrated location of the mid-plane 37 causes the fixture to begin rolling on its rounded grill. Still another feature is that the front region of the bottom portion 54 of the base 50 is also rounded in much the same way as the grill, and it therefore has nothing on it to impede lateral roll-over, thus also acting like a wheel on the horizontal support surface 56.

The position of the fixture depicted in FIG. 5 is sometimes referred to herein as the position of initial contact between the central portion of the grill periphery and the horizontal support surface 56 following tip-over of the fixture in the direction of its front face. It is from this position of initial contact that the fixture will roll over laterally into a position typified by that depicted in FIG. 6, where the center line 65 of the light beam emerging from the lamp housing 12 is angularly offset from a perpendicular 67 to the support surface 56. When the fixture is in its FIG. 6 position, the light beam has a substantially reduced capacity to heat the surface 56 as compared to that which would be present if the fixture were allowed to remain in its initial-contact position of FIG. 5.

Figure 7:
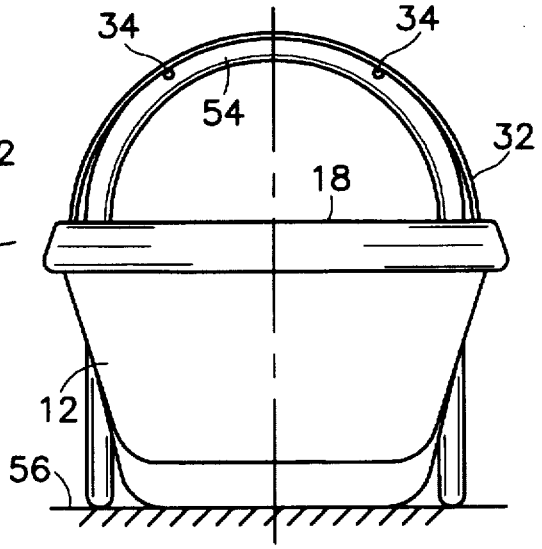
FIG. 7 is a front view of a modified form of fixture after it has rolled over into another possible position following its being tipped over into a position corresponding to that of FIG. 5.

Although FIG. 6 is a typical position into which the fixture will roll after being tipped over, the fixture can be made, with appropriate minor design changes, to sometimes roll over even further in a lateral direction and, more specifically, into the position depicted in FIG. 7. In this position, the center line 65 of the beam is aimed away from and roughly perpendicular to the support surface 56, and the beam is thus even less likely to heat such surface than it would if the fixture came to rest in the position of FIG. 6. To promote roll-over into the FIG. 7 position, the back end of the support base 50 in the FIG. 7 embodiment is shortened. Whether such fixture will end up in the position of FIG. 6 or that of FIG. 7 depends upon the location of its center of gravity, the force with which it was tipped over, the direction of such force, and the nature of support surface 56.

It is to be noted that the fixture is free to roll over from its position of FIG. 5 either to the left or to the right since its components 32 and 54 are rounded on both sides of its central plane 37. The direction of roll-over will depend upon such factors as the direction of the tip-over force and the character and orientation of support surface 56.

In some applications it is sufficient if roll-over of the fixture is terminated before the fixture reaches its position of FIG. 6, e.g., when the beam center line 65 is at 45 to 90 degrees to a line disposed perpendicular to the illustrated support surface 56 the perpendicular line 67. Such termination can be effected by appropriately shaping the base 50 to stop roll-over after the desired angular motion of the fixture.

While we have described and illustrated particular embodiments of our invention, it will be apparent to those skilled in the art that various changes and modifications may be made without departing from the invention in its broader aspects; and we, therefore, intend to cover all such changes and modifications as fall within the true spirit and scope of our invention.

What we claim as new and desire to secure by Letters Patent of the United States is:

1. A portable lighting fixture comprising:

(a) a housing which is adapted to receive a lamp, the housing having two spaced-apart sidewalls, a front face extending between said sidewalls, and an opening in said front face, (b) a reflector within said housing for reflecting light from said lamp through said opening, (c) a protective grill on said housing registering with said opening in a location in front of said opening, (d) a base normally supporting said housing and atop which said housing is normally located, and in which:

(e) the grill has an outer periphery that appears rounded when viewed from a horizontal reference plane located above said housing when the housing is in its normal location atop said base, the grill containing a central peripheral portion when so viewed, (f) tip-over of said fixture onto a horizontal fixture-supporting surface that causes the central peripheral portion of the grill initially to contact said horizontal surface results in the fixture rolling over in a lateral direction on said outer periphery of the grill following said initial contact, (g) the fixture is unstable in resisting roll-over of the fixture from said position of initial contact following tip-over of said fixture, thereby promoting lateral roll-over from said position of initial contact on the rounded outer periphery of the grill following such tip-over, and (h) said base has a front portion configured so as to avoid obstructing lateral roll-over of said fixture from said position of initial contact in the event of tip-over of said fixture into said position of initial contact.

2. The fixture of claim 1 in which lateral roll-over of the fixture from said position of initial contact carries the fixture into a position in which said reflector reflects light from said lamp via a beam having a center line that is angularly offset from a perpendicular to said supporting surface by an amount sufficient to substantially reduce heating of said supporting surface as compared to that present if the beam was perpendicular to and aimed at said supporting surface.

3. The fixture of claim 1 in which lateral roll-over of the fixture from said position of initial contact carries the fixture into a position in which said reflector reflects light from said lamp via a beam that is oriented to produce substantially less heating of said horizontal supporting surface than would be the case if said fixture remained in its position of initial contact with said supporting surface.

4. The portable lighting fixture of claim 1 in which said base has an outer peripheral portion facing toward the front of said fixture, said outer peripheral portion of the base appearing rounded when viewed from said horizontal reference plane located above said housing, thereby providing a base configuration that facilitates roll-over of said fixture following said tip-over.

5. The portable lighting fixture of claim 3 in which said base has an outer peripheral portion at the front of said fixture, said outer peripheral portion of the base appearing rounded when viewed from said horizontal reference plane located above said housing, thereby providing a base configuration that facilitates roll-over of said fixture following said tip-over.

6. The fixture of claim 1 in which lateral roll-over of the fixture from said position of initial contact carries the fixture into a position in which said reflector reflects light from said lamp via a beam having a center line that is aimed away from said supporting surface.

7. The lighting fixture of claim 1 in which said grill comprises:

(a) a first set of members normally spaced-apart vertically and extending generally horizontally via rounded paths when viewed from said reference plane, (b) reinforcing members extending transversely of the members in said first set and attached thereto, said reinforcing members being located on the inner peripheral surfaces of the members in said first set so that the reinforcing members offer no substantial impedance to roll-over of said fixture from said position of initial contact.

8. The fixture of claim 7 in which said members are wires.

9. The lighting fixture of claim 1 in which the grill, when viewed from said reference plane, appears rounded on both sides of a central vertical plane through the fixture when the housing is in its normal location atop said base.

10. A portable lighting fixture comprising:

(a) a housing which is adapted to receive a lamp, the housing having two spaced-apart sidewalls, a front face extending between said sidewalls, and an opening in said front face, (b) a reflector within said housing for reflecting light from said lamp through said opening, (c) a protective grill on said housing registering with said opening in a location in front of said opening, (d) a base normally supporting said housing and atop which said housing is normally located, and in which:

(e) the grill has an outer periphery when viewed from a horizontal reference plane located above said housing when the housing is in its normal location atop said base, the grill containing a central peripheral portion when so viewed, (f) tip-over of said fixture onto a horizontal fixture-supporting surface that causes the central peripheral portion of the grill initially to contact said horizontal surface results in the fixture rolling over in a lateral direction on said outer periphery of the grill following said initial contact, (g) the fixture is unstable in resisting roll-over of the fixture from said position of initial contact following tip-over of said fixture, thereby promoting lateral roll-over from said position of initial contact on the outer periphery of the grill following such tip-over, and (h) said base has a front portion configured so as to avoid obstructing lateral roll-over of said fixture from said position of initial contact in the event of tip-over of said fixture into said position of initial contact.

11. The fixture of claim 10 in which lateral roll-over of the fixture from said position of initial contact carries the fixture into a position in which said reflector reflects light from said lamp via a beam having a center line that is angularly offset from a perpendicular to said supporting surface by an amount sufficient to substantially reduce heating of said supporting surface as compared to that present if the beam was perpendicular to and aimed at said supporting surface.

12. The fixture of claim 10 in which lateral roll-over of the fixture from said position of initial contact carries the fixture into a position in which said reflector reflects light from said lamp via a beam that is oriented to produce substantially less heating of said horizontal supporting surface than would be the case if said fixture remained in its position of initial contact with said supporting surface.

13. The portable lighting fixture of claim 10 in which said base has an outer peripheral portion facing toward the front of said fixture, said outer peripheral portion of the base appearing rounded when viewed from said horizontal reference plane located above said housing, thereby providing a base configuration that facilitates roll-over of said fixtures following said tip-over.

* * * * *